US006588759B1

(12) United States Patent
Bateman

(10) Patent No.: US 6,588,759 B1
(45) Date of Patent: Jul. 8, 2003

(54) TARGET BAFFLE BRACKET

(75) Inventor: Kyle E. Bateman, Provo, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 09/618,886

(22) Filed: Jul. 18, 2000

(51) Int. Cl.[7] ..... F41J 1/20

(52) U.S. Cl. ..... 273/407; 273/410; 248/328; 108/107

(58) Field of Search ..... 108/144, 147, 108/17, 11, 148, 149, 106, 107; 248/328, 327, 322; 52/39; 273/407, 410, 404, 405; 89/36.06, 36.07

(56) References Cited

U.S. PATENT DOCUMENTS 3,404,887 A 10/1968 Dundr
3,508,302 A * 4/1970 Settanni ..... 24/71.1
3,701,532 A 10/1972 Nikoden
3,737,165 A 6/1973 Pencyla
4,723,749 A * 2/1988 Carraro et al. ..... 24/336
4,786,059 A 11/1988 Barini
5,127,340 A * 7/1992 Maro et al. ..... 108/107
5,456,155 A * 10/1995 Myrtoglou ..... 273/410
5,535,662 A * 7/1996 Bateman ..... 273/394
5,600,084 A * 2/1997 Gonzalez ..... 89/36.02
5,779,068 A * 7/1998 Whiten et al. ..... 108/107
5,822,936 A * 10/1998 Bateman ..... 109/1 R
5,848,794 A 12/1998 Wojcinski et al.

* cited by examiner

*Primary Examiner*—Mark S. Graham
(74) *Attorney, Agent, or Firm*—Morriss, Bateman, O'Bryant & Compagni

(57) ABSTRACT

A target baffle bracket includes an elongate piece of material having a hanger portion and a backing portion. The backing portion is configured for attachment to adjoining metal plates so as to cover the joint between the plates. The hanger portion is configured for selectively engaging a cable. To facilitate adjustment in the height of the bracket, and thus the baffle which it helps form, the hanger portion includes cable receiving recesses which are disposed in a variety of vertical positions.

29 Claims, 6 Drawing Sheets

TARGET BAFFLE BRACKET

BACKGROUND OF THE INVENTION

1. Field of the Invention

The present invention relates a Target Baffle Bracket which facilitates installation of the target baffle. More specifically, the present invention relates to a bracket which connects adjacent plates of a baffle and provides an adjustable mounting mechanism for the baffle, and which reduces the overall number of parts necessary to securely hang a baffle.

2. State of the Art

In order to maintain proficiency in the use of firearms, it is common for law enforcement officers and sportsmen to engage in target practice. Target practice was traditionally conducted in outdoor settings where preventing ricochets of the bullet deceleration medium was the primary concern. Firing ranges commonly used a large mound of earth to decelerate the bullet after it had passed through the target. Such systems generally prevented injury from ricochets, etc., because the dirt was effective in stopping the bullets.

More recently, however, considerable concern has been raised about the lead contained in the bullet. Though the bullet fired in to the mound of dirt was safely contained from the point of being a moving projectile with a significant amount of inertial momentum, the lead in the bullet was free to leach into the environment. Thus, the more recent trend in shooting ranges has also stressed containment and removal of the bullet to prevent lead contamination of the environment.

In addition to the containment of lead bullets, there is also a desire to build shooting ranges within enclosed structures. For example, many police departments will have a shooting range within the police station. Having the range disposed inside is advantageous because it can be used frequently regardless of the weather and without undue travel time.

The current trend in bullet containment systems has focused on two different types of systems. One kind of containment system, often called a bullet stop and containment chamber, has a pair of plates which channel bullets toward an opening in a containment chamber. Inside the containment chamber are impact plates which slow the bullet to a stop. (As used herein, bullet includes bullets, shot and other forms of projectiles)

Bullet stop and containment chambers are highly advantageous because the entire deceleration process is controlled by sheets of steel plate. Such a system can withstand hundreds of thousands, if not millions, of rounds without showing excessive wear.

Another, less expensive, approach to bullet containment in Bullet backstops typically include a back wall plate made of steel. The back wall plate is usually disposed transverse to the ground at an angle of about 30–38 degrees. On an upper side of the wall, a layer of impact material is disposed to provide a medium for decelerating bullets which is several feet thick along the plane the bullet travels.

Regardless of which type of bullet containment device is used, it is important that bullets be directed toward the bullet containment device and not ricocheted toward the shooter or others persons who may be in the vicinity. To this end, it is common to have baffles disposed along a shooting range which are configured to deflect rounds toward the bullet containment device and to otherwise prevent ricochets which may injure individuals.

One problem with the formation of baffles is the manner in which the baffles are hung. As shown in FIG. 1, it is common to form a baffle, generally indicated at 4, out of several pieces of metal plate 8. The metal plates are then secured together either by welding or by a backing strip 12. Those skilled in the art will appreciate that welding is disadvantageous because it effects the temper of the plates and is costly.

To hang the baffle in plate, a plurality of attachment brackets 16 are welded or otherwise attached to the baffle 4. A plurality of cables 20 are then used to connect the attachment brackets to a ceiling support (not shown) . To allow adjustment of the baffle 4, a turnbuckle 24 is disposed along the cable. The turnbuckle 24 allows for adjustment of the length of the cable 20 to engage each attachment bracket and provide stable support for the baffle 4.

While such attachment methods securely hold the baffle in place, they are generally expensive and require the installer to user both of his or her hands when securing the cables 20 to try and support the baffle 4. Thus, there is a need for an improved target baffle bracket which reduces cost and increases the ease of installation.

SUMMARY OF THE INVENTION

Thus, it is an object of the present invention to provide an improved target baffle bracket which reduces cost of installation.

It is another object of the present invention to provide such a target baffle bracket which is easy to install.

It is another object of the present invention to provide such a target baffle bracket which is used both to form and hang the baffle.

It is still another object of the present invention to provide such a baffle with improved rigidity.

It is yet another object of the present invention to provide such a target baffle bracket which facilitates minor adjustments in the height of portions of the baffle.

The above and other objects of the invention are realized in specific illustrated embodiments of a baffle bracket including a plurality of cable attachment locations. The cable attachment locations are configured for enabling a cable to be attached to the bracket and adjusted without the need for a turn buckle or other similar adjustment mechanism.

In accordance with one aspect of the invention, the bracket is formed of a piece of metal having a generally L-shaped cross-section, and including a lower bracket configured for attachment to two metallic plates. The bracket thus also forms the backing strip for adjacent metallic plates forming the baffle.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
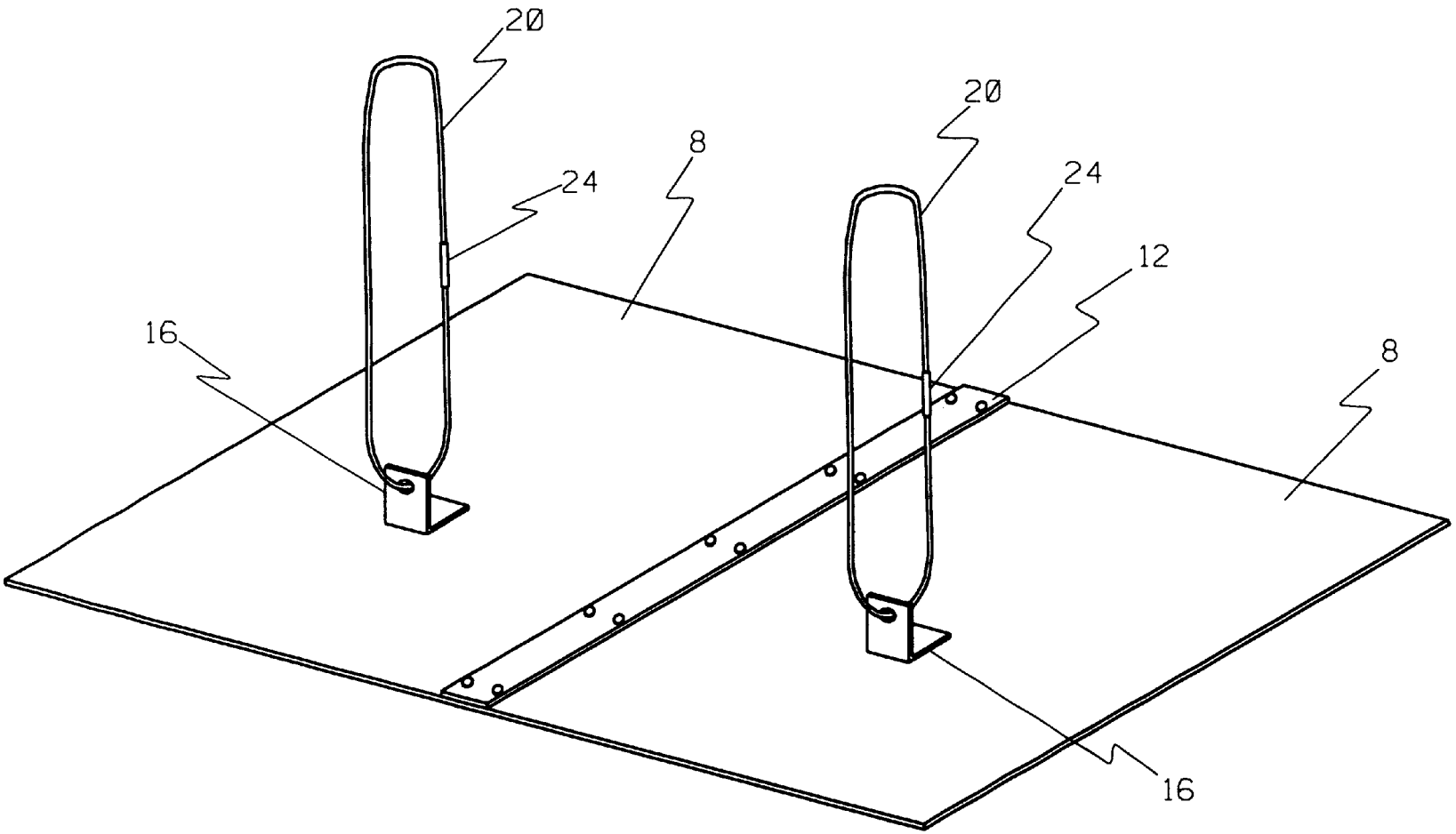
FIG. 1 (Prior Art)
FIG. 1 shows a perspective view of a baffle formed in accordance with the principles of the prior art.

Referring to FIG. 1, there is shown a perspective view of a prior art target baffle configuration. As mentioned in the background section, the baffle 4 is formed by a plurality of metallic plates 8 which are joined together by a backing strip 12 which is attached to each plate. A pair of hanging brackets 16 are attached to the plates 8 and receive a cable 16 which supports the weight of the baffle 4. Each cable typically includes a turnbuckle 24 which allows the installer to make fine adjustments in the hanging of the baffle 4.

Figure 2A:
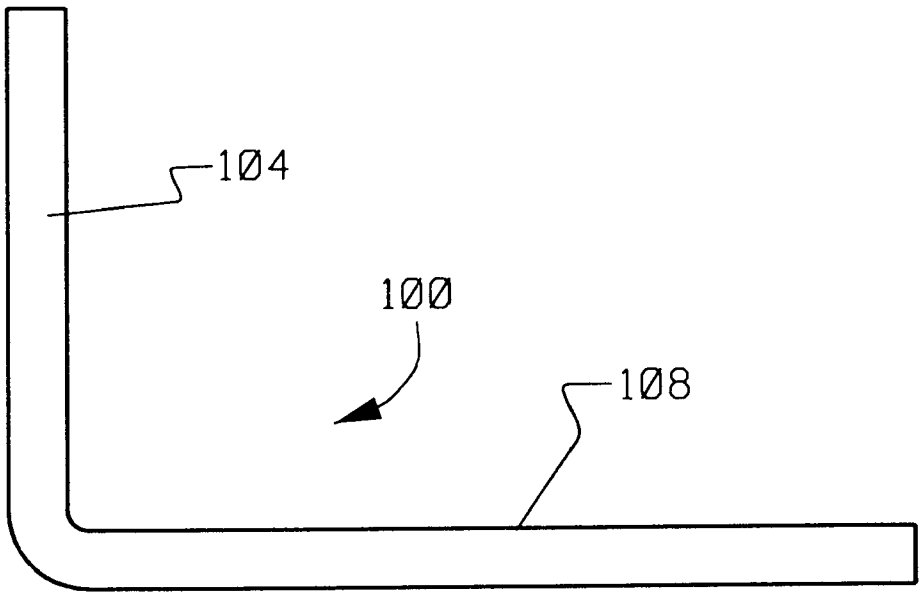
FIG. 2A shows an end view of a baffle bracket made in accordance with the principles of the present invention.

Turning now to FIG. 2A, there is shown an end view a baffle bracket, generally indicated at 100, made in accordance with the principles of the present invention. The baffle bracket 100 includes a hanger portion 104 and a backing portion 108 which extend generally perpendicular to one another so as to form a bracket with a generally L-shaped cross-section. As shown in FIG. 2A, the hanger portion 104 is preferably about three inches high, while the backing portion 108 is preferably about four inches wide.

It will be appreciated from the description of the present invention contained herein that other configurations could also be used. For example, instead of a piece of metal having a generally L-shaped cross-section, the bracket 100 could be formed from a piece of metal having an inverted T-shaped cross-section.

The backing portion 108 is preferably four inches wide to provide the backing portion with sufficient width to form a backing plate over the ends of two adjacent plates (such as plates 8 in FIG. 1). Four inches is sufficiently wide to permit the backing portion 108 to be bolted, riveted or otherwise attached to both plates.

The hanging portion 104 is preferably about three inches high because such a distance allows easy access to attachment locations (discussed below). The height also provides additional rigidity for the bracket 100 to minimize bending in the event that the backing portion 108 takes a forceful hit from a round.

Figure 2B:
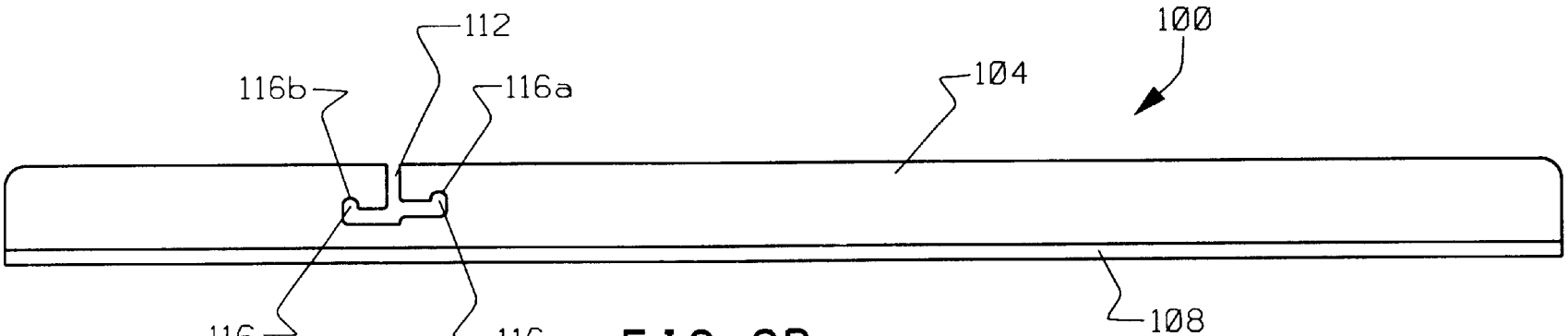
FIG. 2B shows a side view of the baffle bracket shown in FIG. 2A.

Turning now to FIG. 2B, there is shown a side view of the bracket 100. The side view shows the hanger portion 104 and the end of the backing portion 108. Formed in the hanger portion 104 is at least one hanger channel 112. The hanger channel 112 forms a plurality of locations 116 configured for receiving a hanger cable (not shown). Preferably, the hanger channel 112 has a first arm 112*a* which terminates in a first cable receiving recess 116*a* which is 0.75 inches from the top of the hanger portion 104.

The hanger channel 112 also includes a second arm 112*b* which terminates in a second cable receiving recess 116*b* which is one inch from the top of the hanger portion. The first and second cable receiving recesses 116*a* and 116*b* enable the installer to position a hanger cable at either of the recesses and thereby adjust the relative position of the baffle 100 without requiring a turnbuckle or other cable adjustment device which necessitates the use of two hands during installation.

The vertical distance between the first cable receiving recess 116*a* and the second cable receiving recess 116*b* depends, in part, at the angle at which the baffle is disposed when suspended (typically 15–30 degrees). If the baffle 100 were held in a horizontal configuration, of course, the first cable receiving recess 116*a* is disposed 0.25 inches higher than the second cable receiving recess 116*b*. When hanging, however, the first cable receiving recess 116*a* may be slightly lower than the second cable receiving recess 116*b* depending on the angle of the baffle relative to the ground. Those skilled in the art will appreciate that the relative orientation of the first cable receiving recess 116*a* and the second cable receiving recess 116*b* may be formed at different relative positions depending on the anticipated orientation of the baffle 100. (It should be appreciated that, as used herein, "cable" includes conventional baffle cables, chains, rope and other similar baffle hanging apparatuses.)

While shown in FIG. 2B as having a single hanger channel 112, those skilled in the art will appreciate that the baffle bracket 100 may have a plurality of hanger channels and cable receiving recesses depending on the length of the bracket, among other things. Examples of embodiments utilizing multiple hanger channels are discussed below. Additionally, while showing first and second recesses 116*a* and 116*b*, additional recesses could also be provided. To enable still further adjustment to the height at which the cable engages the hanger portion 104.

Figure 2C:
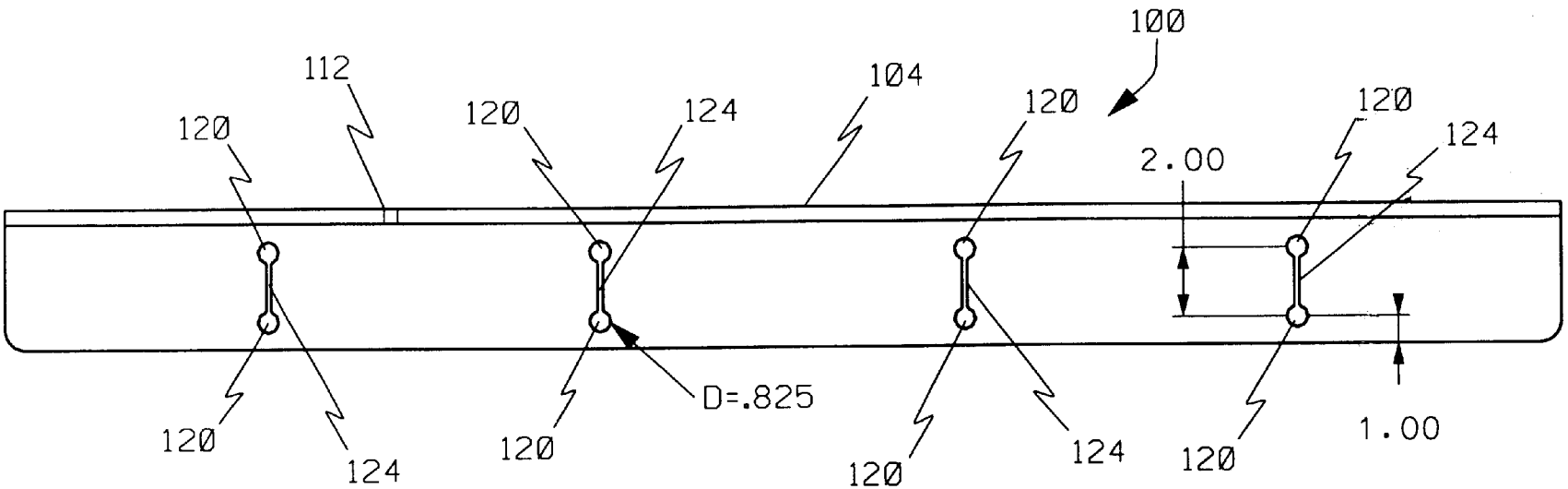
FIG. 2C shows a top view of one embodiment of the baffle bracket shown in FIG. 2A.

Turning now to FIG. 2C, there is shown a top view of the baffle bracket 100 of FIG. 2A. As was mentioned previously, the baffle bracket 100 includes a backing portion 108. The backing portion 108 has a plurality of fastener receiving holes 120 formed therein. As shown in FIG. 2A, the holes 120 are preferably connected by a short channel 124, thereby giving the holes the shape of a dumb bell. It has been found that forming the fastener receiving holes 120 in the shape of a dumb bell facilitates formation while providing no discernable loss of bullet stopping ability.

The fastener receiving holes 120 of the backing portion 108 are configured to receive the bolts, rivets, etc. which are disposed along the lateral edge of a metallic plate forming the baffle so that the backing portion connects two adjacent metallic plates to form a continues baffle. Preferably, the backing portion 108 is about 4 inches wide, and the fastener receiving holes 120 are spaced apart about two inches.

The backing portion 108 also forms a backing strip along the joint between two metal plates to prevent bullets impacting the plates along their interface from passing between the plates. Because the fastener receiving holes 120 are filled with bolts, rivets, etc., and the channels 124 are typically much smaller than a bullet, the risk of a bullet passing between two plates and then through any opening in the backing portion 108 of the baffle bracket is very small.

While the backing portion 108 of the baffle bracket 100 attaches the metallic plates, the hanger portion 104 enables the bracket (and the attached plates) to be suspended from a ceiling support and to be adjusted without adjusting the support cable.

By using a single bracket 100 to connect the metallic plates together, to form a backing along the edges of the plates, to hang the baffle and to adjust the position of the baffle, considerable time and expense is saved both in a reduced number of components which are used to assemble the baffle, and in reduced installation time.

Figure 3:
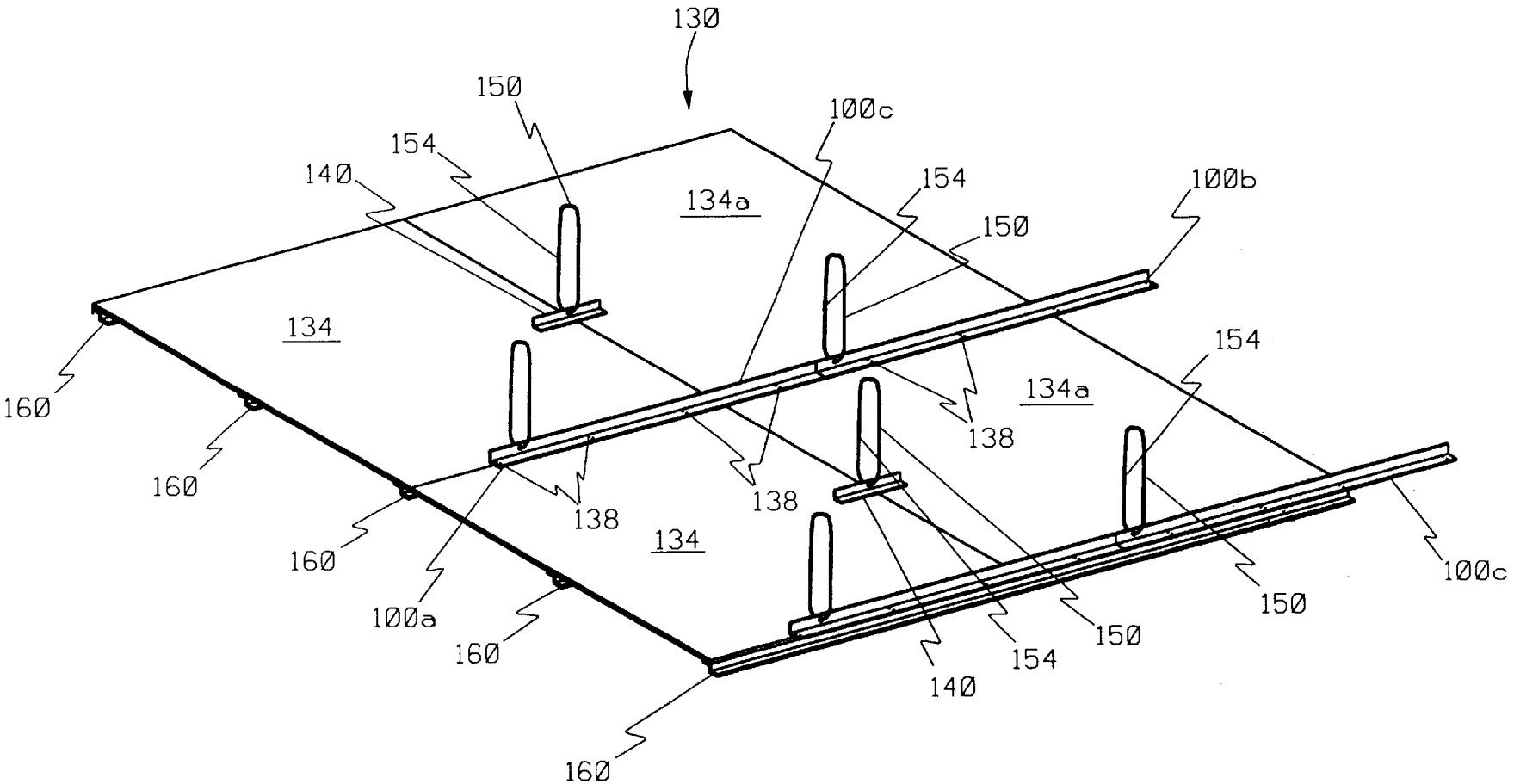
FIG. 3 shows a perspective view of a target baffle utilizing a target baffle bracket made in accordance with the principles of the present invention.

Turning now to FIG. 3, there is shown a perspective view of a target baffle 130 utilizing a pair of target baffle brackets 100, such as that shown in FIGS. 2A through 2C. The baffle 130 is formed by a plurality of plates 134 which are attached together by a plurality of target baffle brackets 100. Each of the target baffle brackets 100 is configured to receive four pairs of bolts 138 which attach to the adjoining sides of the plates 134.

As shown by target baffle brackets 100*a* and 10*b*, it is presently preferred to have the first baffle bracket 100 begin about ¼th the way down the joint between the plates 134. This allows the lower end 100*c* to extend down and be bolted to the plates 134*a* which are positioned below, thereby holding the plates 134 and 134*a* together more securely. Likewise, target baffle bracket 100*b* extends beyond the lower end of the plates 134*a* so that it may be attached to the next row of plates.

From the present disclosure, those skilled in the art will appreciate that the first target baffle bracket 100*a* could be lengthened to cover the entire joint between plates 134, which still attaching to plates 134*a*. Likewise, the last target baffle bracket 100*c* can be shorter than the others so that it does not extend beyond the lower end of the baffle 130.

Also shown in FIG. 3 are a plurality of support brackets 140 which are disposed along the middle edge of adjoining plates so as to hold plates 134 to plates 134*a* and to further support the baffle 130. Preferably, the support brackets have a hanger channel, such as that discussed above.

Each of the brackets 100 and 140 receive a cable 150. Unlike the prior art (cable 20 in FIG. 1), the cables 150 do not include a turnbuckle or other similar adjustment mechanism. Rather, a crimp 154 or some other secure fastener is used to hold the cable at its predetermined length.

As the cables 150 are attached to the target baffle brackets 100, the user is able to slide the cable into the appropriate cable receiving recess 116*a* or 116*b* (FIG. 2B) to ensure that the baffle is properly supported.

While the baffle 130 may provide bare metal on the underside for deflecting bullets, it can also have a bullet arresting frame attached thereto. There are a variety of different bullet arresting frames which can be attached to the baffle 130. For example, FIG. 3 shows a plurality of frame supports 160 which a z-shaped cross-section and which are used to attached plywood or other material to the baffle 130 so that bullets hitting the baffle are retained within the frame.

Figure 4A:
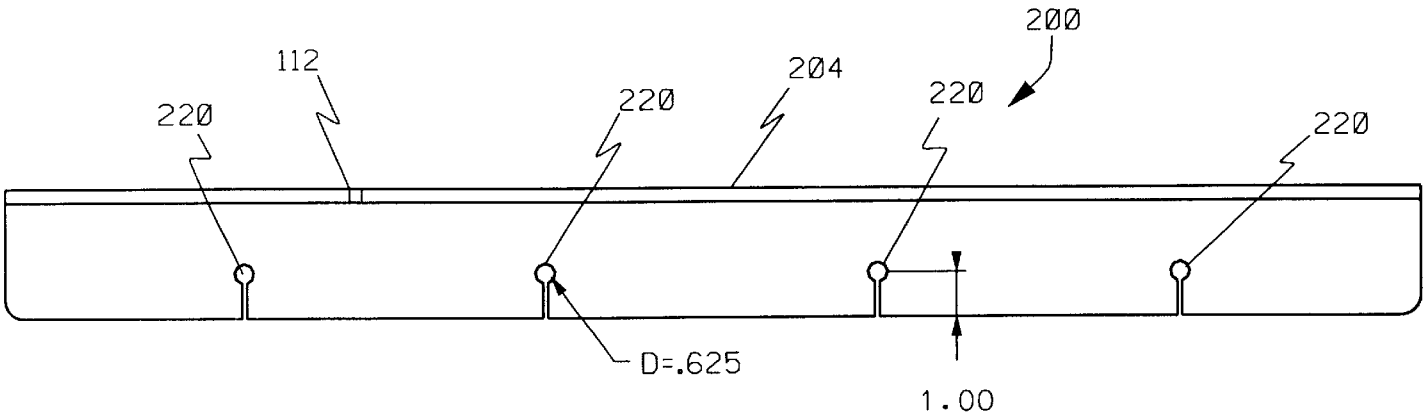
FIG. 4A shows a top view of an alternate configuration of a baffle bracket formed in accordance with the principles of the present invention.

FIG. 4A shows a top view of an alternate configuration of a baffle bracket, generally indicated at 200, formed in accordance with the principles of the present invention. Like the baffle bracket 100 of FIGS. 2A through 3, the baffle bracket 200 includes a hanger portion 204 with a hanger channel. Unlike the baffle bracket 100, however, the backing portion 208 of the baffle bracket 100 is provided with single fastener receiving holes 220. Typically, the baffle bracket 200 is used either along the edge of the outside plate, or along the middle of the plate as a support bracket similar to that shown in FIG. 3. Because only a single fastener receiving hole 220 is positioned at each location, the backing portion 208 need only be about 2.75 inches wide, rather than the 4 inches of the backing portion 108 in FIGS. 2A through 3.

Figure 4B:
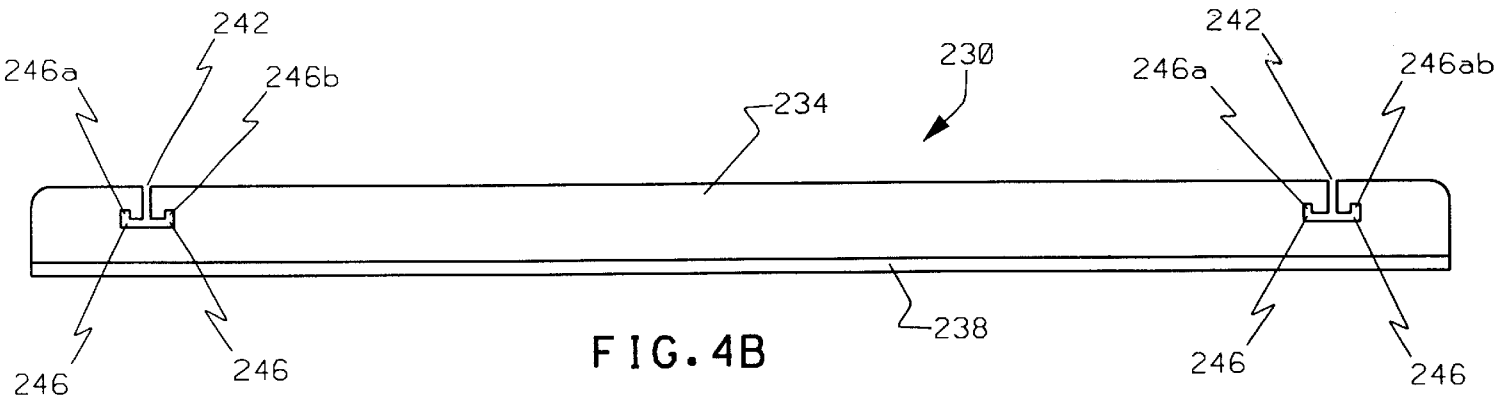
FIG. 4B shows a side view of an alternate embodiment of a baffle bracket formed in accordance with the principles of the present invention.

Turning now to FIG. 4B, there is shown a side view of an alternate embodiment of a baffle bracket 230 made in accordance with the principles of the present invention. The baffle bracket 230 is formed by a hanger portion 234 and a backing portion 238.

Formed in the hanger portion 234 is a pair of hanger channels 242. The hanger channels 242 each include a first cable receiving recess 246*a* and a second cable receiving recess 246*b* which are disposed at the end of arms 246 extending from the hanger channels 242.

As shown in FIG. 4B, the first cable receiving recess 246*a* and the second cable receiving recess 246*b* are disposed in the same vertical position. When the baffle bracket 230 is disposed at an angle of, for example, 30 degrees, the first and second cable receiving recesses 246*a* and 246*b* become off set by approximately 0.5 inches. Thus, a know amount of adjustment is available by simply choosing between the first cable receiving recess 246*a* and the second cable receiving recess 246*b*.

Figure 4C:
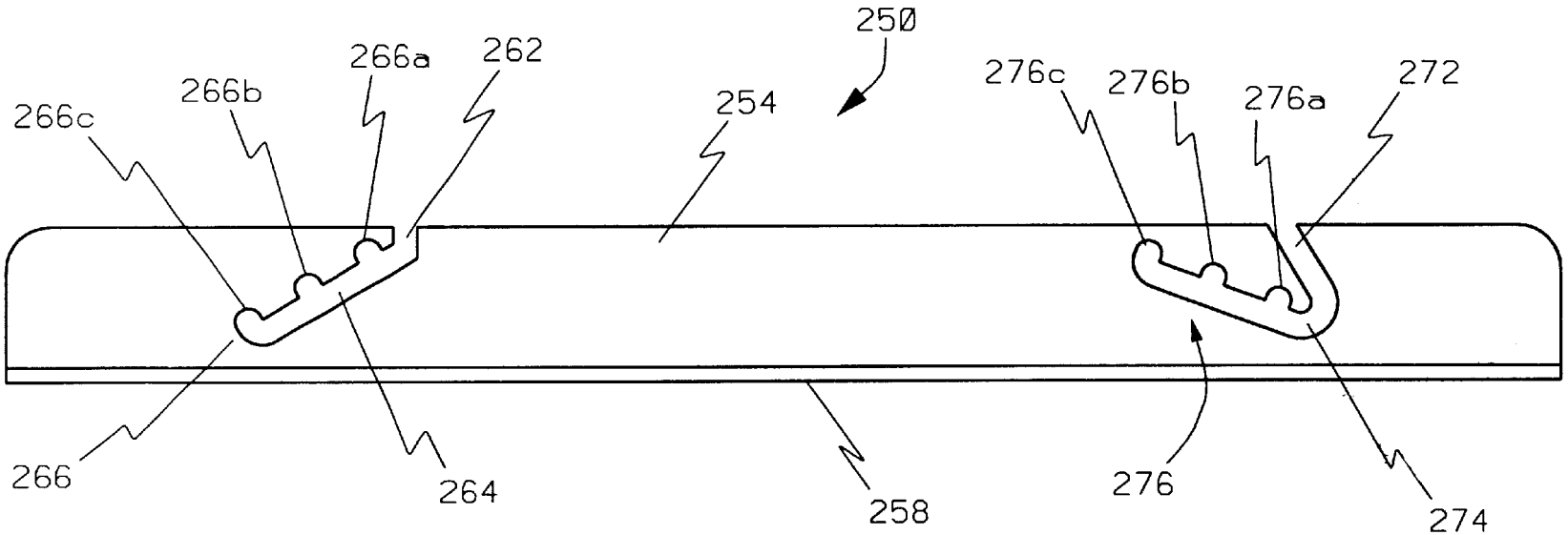
FIG. 4C shows a side view of yet another embodiment of the principles of the present invention.

Turning now to FIG. 4C, there is shown a side view of yet another embodiment of the present invention demonstrating other possible configurations of the hanger slots and associated cable receiving recesses. The target baffle bracket 250 is formed from a hanger portion 254 and a backing portion 258 preferably formed by an L-shaped piece of metal. As explained earlier, the L-shape of the piece of metal allows for convenient adjustment and creates a very strong hanger/backing strip which is unlikely to allow any bullet fragments to pass through the baffle.

Disposed in the hanger portion 254 is a first hanger channel 262. The hanger channel 262 has a single arm 264 with cable receiving recesses, generally indicated at 266 disposed therealong. As shown in FIG. 4C, the arm has a first cable receiving recess 266*a*, a second cable receiving recess 266*b*, and a third cable receiving recess 266*c*. The exact vertical distance between the recesses 266 depends on the angle of the arm 264 of the channel 262, the distance between the cable receiving recesses 266*a–c* and the angle at which the baffle is to be disposed.

FIG. 4C also shows a second hanger channel 272 having an arm 274 with a plurality of cable receiving recesses, generally indicated at 276, disposed along the arm of the channel. As shown, the arm has a first cable receiving recess 276*a*, a second cable receiving recess 276*b* and a third cable receiving recess 276*c*.

In contrast to the hanger channel 262, the cable receiving recesses 276 of the hanger channel 272 are arranged in ascending order. Those skilled in the art will appreciate that a baffle bracket 250 will typically use two similar hanger channels 262 or 272, rather than two with opposing configurations. The two configurations are shown in FIG. 4C for purposes of showing the various combinations which may be used.

By providing a plurality of cable receiving recesses, 116, 246, 266 or 276 which are disposed in a variety of positions when the baffle bracket 100, 200, 230, 250 is inclined, the installer is able to readily connect the baffle bracket, and thus the baffle, to the appropriate support structure without repeatedly attempting to adjust turnbuckles or other similar configurations. Additionally, because the cable 150 (FIG. 3) does not need to threaded through hole in the bracket, such as shown on bracket 16 of FIG. 1, the installation is more rapid and requires less manual dexterity of the installer. If it is discovered after installation that the baffle is uneven, the installer need only slide the cable from one cable receiving recess to another in order to adjust the orientation of the baffle. In contrast, the prior art requires the use of tools and adjustment of the turnbuckle 254.

Thus there is disclosed an improved target baffle bracket and a method of using the same. Those skilled in the art will appreciate numerous modifications which can be made without departing from the scope and spirit of the present invention. The appended claims are intended to cover such modifications.

What is claimed is:

1. A baffle configured for deflecting bullets, the baffle comprising:

a plurality of pieces of metal plate disposed adjacent one another so as to form a joint; and at least one baffle bracket comprising:

a backing portion attached to the adjacent pieces of metal plate so as to cover the joint; and a hanger portion extending upwardly from the backing portion, the hanger portion having at least one hanger channel formed therein for receiving a cable, the hanger channel having an opening along a side of the hanger portion and an arm extending inwardly from the opening.

2. The baffle according to claim 1, wherein the hanger channel has a plurality of cable receiving recesses formed therein.

3. The baffle according to claim 2, wherein the cable receiving recesses are formed at different vertical positions.

4. The baffle according to claim 3, wherein the at least one baffle bracket is attached to four metal plates.

5. The baffle according to claim 1, wherein the backing portion comprises a plurality of holes configured for receiving fasteners for attaching the backing portion to the metal plates.

6. The baffle according to claim 5, wherein at least two of the plurality of holes are connected by a channel.

7. The baffle according to claim 1, further comprising a nonadjustable cable.

8. The baffle according to claim 1, wherein the hanger portion and the backing portion are disposed perpendicular to one another.

9. The baffle according to claim 1, wherein the hanger portion and the backing portion are disposed perpendicular to one another.

10. A method for hanging a baffle, the method comprising:

selecting a plurality of metal plates and at least one baffle bracket having a backing portion and a hanger portion with at least one hanger channel formed therein, the at least one hanger channel forming a plurality of cable receiving recesses;

attaching adjoining edges of the metal plates together with the backing portion of the baffle bracket; and sliding a cable into the at least one hanger channel of the hanger portion until the cable rests in one of the cable receiving recesses.

11. The method according to claim 10, wherein the method further comprises disposing the baffle bracket at an angle such that the plurality of cable receiving recesses are disposed at different vertical positions.

12. The method according to claim 11, wherein the method further comprises selectively placing the cable in a cable receiving recess based to adjust the position of the baffle bracket.

13. A method for hanging a baffle, the method comprising:

selecting a plurality of metal plates and at least one baffle bracket having a backing portion and a hanger portion with at least one hanger channel formed therein;

attaching adjoining edges of the metal plates together with the backing portion of the baffle bracket; and sliding a cable into the at least one hanger channel of the hanger portion until the cable rests in one of the cable receiving recesses; and wherein the method comprises selecting a baffle bracket having a plurality of holes disposed in pairs and a channel extending between the holes of each pair.

14. A baffle configured for deflecting bullets, the baffle comprising:

a plurality of pieces of metal plate disposed adjacent one another so as to form a joint; and at least one baffle bracket comprising:

a backing portion attached to the adjacent pieces of metal plate so as to cover the joint; and a hanger portion extending upwardly from the backing portion and configured for receiving at least one cable, the hanger portion comprising at least one channel with a plurality of recesses disposed long the channel for receiving the cable at the plurality of recesses.

15. The baffle according to claim 14, wherein the backing portion has a plurality of holes for receiving fasteners and wherein the plurality of pieces of metal plate are attached to the backing portion by fasteners extending through the holes.

16. The baffle according to claim 15, wherein at least two of the plurality of holes are connected by a channel.

17. A method for hanging a baffle, the method comprising:

selecting a plurality of metal plates and at least one baffle bracket having a backing portion and a hanger portion extending upwardly from the backing portion, the hanger portion having at lease one channel disposed therein with recesses disposed long the channel;

fastening adjoining edges of the metal plates to the backing portion of the baffle bracket; and attaching a cable to the hanger portion to hold the bracket in a desired location by positioning the cable in one of the recesses.

18. The method according to claim 17, wherein the method further comprises selecting a baffle bracket wherein the at least one hanger channel forms a plurality of cable receiving recesses, and sliding the cable in the at least one hanger channel until the cable rests in the cable receiving recess.

19. A method for building a bullet deflecting device comprising:

selecting a plurality of metal plates and at least one bracket having a backing portion and a hanger portion with at least one hanger channel formed therein, the at least one hanger channel forming a plurality of cable receiving recesses;

attaching adjoining edges of the metal plates together with the backing portion of the bracket; and sliding a cable into the at least one hanger channel of the hanger portion until the cable rests in one of the cable receiving recesses.

20. The method according to claim 19, wherein the method comprises positioning the bullet deflecting device so that the device deflects bullets into a bullet containment device.

21. The method according to claim 19, wherein the bullet deflecting device comprises a baffle.

22. A bullet deflecting device comprising:

a plurality of pieces of metal plate disposed adjacent one another so as to form a joint; and at least one bracket comprising:

a backing portion attached to the adjacent pieces of metal plate so as to cover the joint; and a hanger portion extending upwardly from the backing portion, the hanger portion having at least one hanger channel formed therein for receiving a cable, the hanger channel having an opening along a side of the hanger portion and an arm extending inwardly from the opening.

23. The bullet deflecting device according to claim 22, wherein the hanger channel has a plurality of cable receiving recesses formed therein.

24. The bullet deflecting device according to claim 23, wherein the cable receiving recesses are formed at different vertical positions.

25. The bullet deflecting device according to claim 24, wherein the at least one bracket is attached to four metal plates.

26. The bullet deflecting device according to claim 21, wherein the backing portion comprises a plurality of holes configured for receiving fasteners for attaching the backing portion to the metal plates.

27. The bullet deflecting device according to claim 25, wherein at least two of the plurality of holes are connected by a channel.

28. The bullet deflecting device according to claim 21, further comprising a nonadjustable cable.

29. The bullet deflecting device according to claim 22, wherein the hanger portion and the backing portion are disposed perpendicular to one another.

* * * * *